US010010786B1

(12) United States Patent
Basyuk

(10) Patent No.: US 10,010,786 B1
(45) Date of Patent: Jul. 3, 2018

(54) ROLL AND STAND-UP TOY AND A GAME USING THE SAME

(71) Applicant: Simon Basyuk, Millburn, NJ (US)

(72) Inventor: Simon Basyuk, Millburn, NJ (US)

( * ) Notice: Subject to any disclaimer, the term of this patent is extended or adjusted under 35 U.S.C. 154(b) by 0 days.

(21) Appl. No.: 15/669,897

(22) Filed: Aug. 5, 2017

(51) Int. Cl.

| | |
|---|---|
| ***A63H 33/00*** | (2006.01) |
| ***A63H 15/08*** | (2006.01) |
| ***A63F 9/00*** | (2006.01) |
| *A63B 67/06* | (2006.01) |

(52) U.S. Cl.
CPC ..... *A63F 9/00* (2013.01); *A63H 15/08* (2013.01); *A63H 33/00* (2013.01); *A63B 2067/061* (2013.01)

(58) Field of Classification Search
CPC ..... A63H 15/08; A63H 33/02; A63H 33/005
See application file for complete search history.

(56) References Cited

U.S. PATENT DOCUMENTS

| | | | | | |
|---|---|---|---|---|---|
| 581,481 | A * | 4/1897 | Leake | A63H 33/005 | 446/458 |
| 2,473,574 | A * | 6/1949 | Davis | A63H 33/00 | 446/243 |
| 2,525,482 | A * | 10/1950 | Grither | A63H 33/00 | 446/431 |
| 2,585,780 | A * | 2/1952 | Johnson | A63H 15/08 | 446/324 |
| 2,752,725 | A * | 7/1956 | Unsworth | A63F 7/042 | 273/109 |
| 3,135,512 | A * | 6/1964 | Taylor | A63F 7/044 | 273/109 |
| 3,451,671 | A * | 6/1969 | May | A63B 26/003 | 280/228 |
| 4,213,266 | A * | 7/1980 | Hyland | A63H 15/08 | 446/431 |
| 4,223,474 | A * | 9/1980 | Strauss | A63H 33/00 | 446/221 |
| 4,501,569 | A | 2/1985 | Clark, Jr. | | |
| 4,595,369 | A | 6/1986 | Downs | | |
| 4,609,196 | A * | 9/1986 | Bozinovic | A63B 43/04 | 446/437 |

(Continued)

*Primary Examiner* — Gene Kim
*Assistant Examiner* — Alyssa Hylinski
(74) *Attorney, Agent, or Firm* — Walter J. Tencza, Jr.

(57) ABSTRACT

A rolling toy to be rolled on a horizontal support surface, for instance, on a floor, having a primary roller and a secondary roller. The primary roller having a tubular-like member extending along a longitudinal axis and at least one annular flange fixedly attached to the tubular-like member and extending outwardly therefrom. The secondary roller is adapted a for rolling motion upon an interior surface of the tubular-like member when the primary roller rotates about the longitudinal axis due to the rolling motion of the rolling toy on the horizontal support surface. At least one of the following includes a helical guiding means: (i) the tubular-like member and (ii) the secondary roller. Thereby, when the secondary roller is disposed on the interior surface of the tubular-like member and the primary roller is set in a rolling motion on the horizontal support surface in a predetermined direction, the rolling motion of the primary roller results in a tilting of the latter. The tilting of the primary roller may result in its standing vertically on the horizontal support surface.

15 Claims, 8 Drawing Sheets

(56) References Cited

U.S. PATENT DOCUMENTS 4,720,283 A * 1/1988 Williams ..... A63F 7/3622 446/168
4,726,800 A 2/1988 Kobayashi
4,902,271 A 2/1990 Yoneda
4,925,428 A * 5/1990 Sonesson ..... A63B 43/04 446/324
5,058,901 A 10/1991 Salvino
5,525,118 A 6/1996 Mock
5,692,737 A 12/1997 Perlsweig
5,928,055 A * 7/1999 Gramsch ..... A63H 15/08 446/297
5,947,793 A 9/1999 Yamakawa
5,951,407 A 9/1999 Teitloff
6,027,412 A 2/2000 Pinel
6,227,933 B1 5/2001 Michaud
6,250,987 B1 6/2001 Choi
6,273,779 B1 8/2001 Boulaire
6,402,630 B1 6/2002 Tyler
6,485,349 B1 * 11/2002 Snyder ..... A63H 29/08 446/168
6,569,025 B1 5/2003 Tyler
6,645,037 B1 11/2003 Choi
7,640,894 B2 * 1/2010 Jager ..... A01K 15/026 119/710
7,753,804 B2 7/2010 Sposato
7,927,170 B2 4/2011 Bickerton
8,057,277 B2 11/2011 Sip
8,584,620 B2 * 11/2013 Rutherford ..... A01K 15/025 119/707
8,858,294 B2 10/2014 Mimlitch, III
8,894,465 B2 11/2014 McClintock
8,939,136 B2 1/2015 Gaus
9,352,237 B1 * 5/2016 Middleton ..... A63H 15/08
2011/0014849 A1 * 1/2011 Sip ..... A63H 17/262 446/457

* cited by examiner

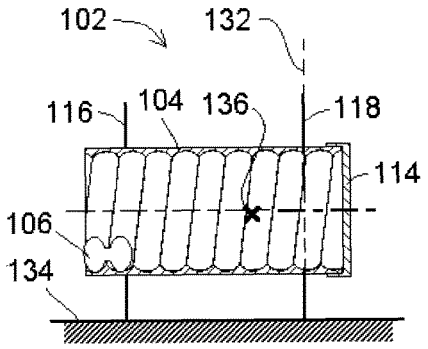
FIG. 4-A
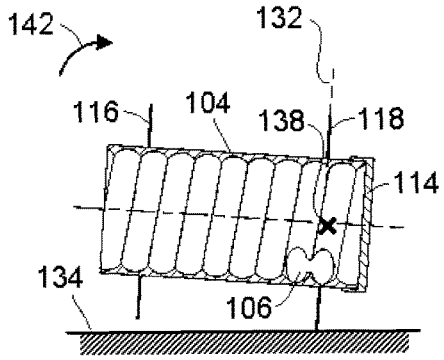
FIG. 4-B
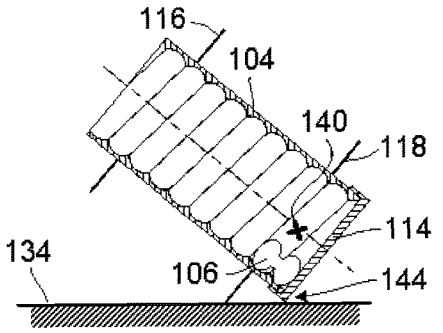
FIG. 4-C
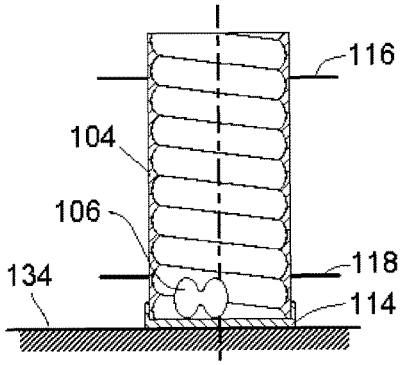
FIG. 4-D
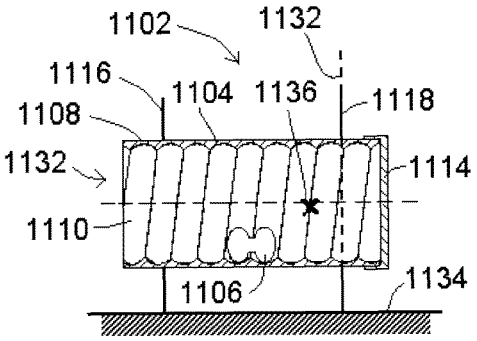
FIG. 11-A
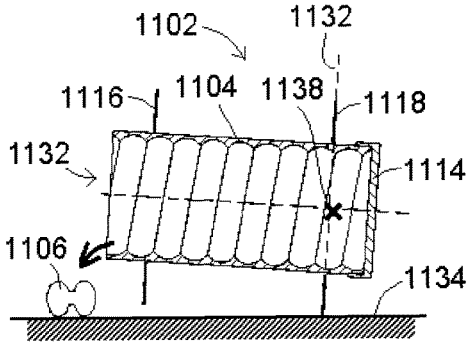
FIG. 11-B

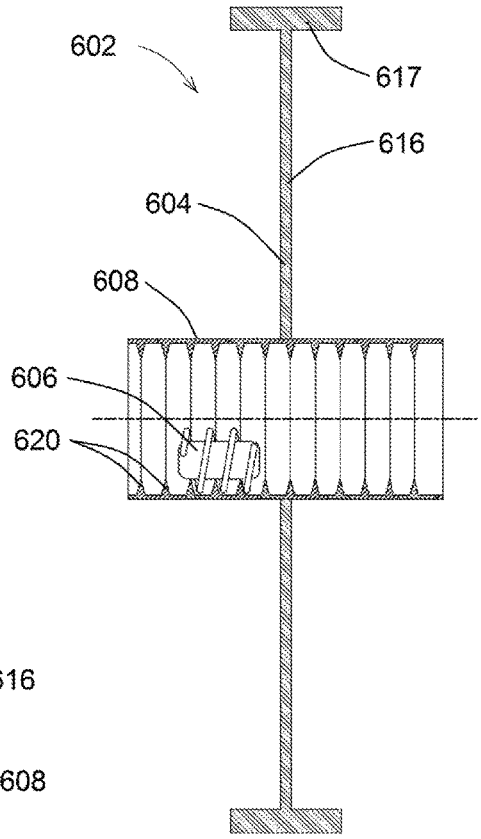
FIG. 12
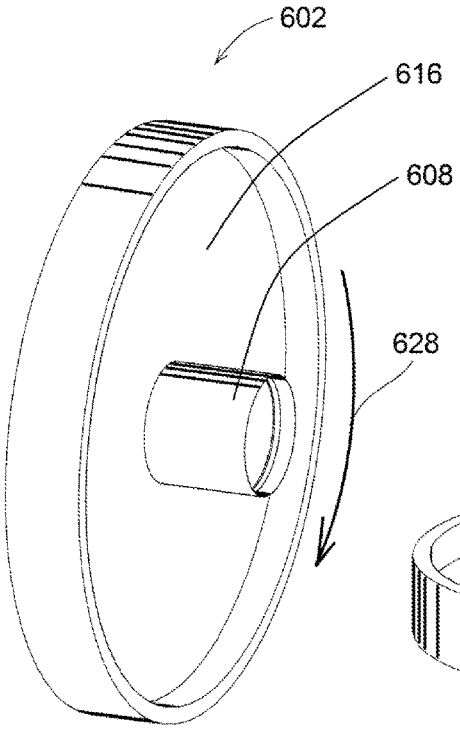
FIG. 13-A
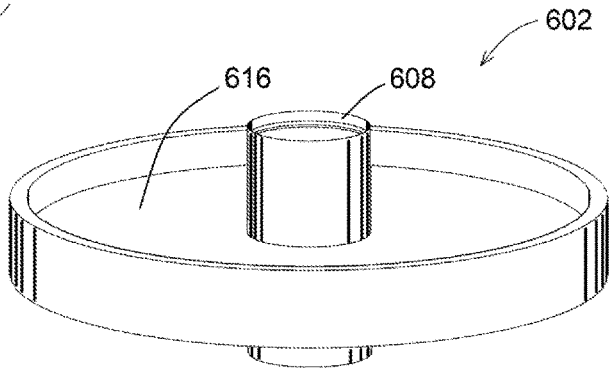
FIG.13-B

ROLL AND STAND-UP TOY AND A GAME USING THE SAME

FIELD AND BACKGROUND OF THE DISCLOSED TECHNOLOGY

The present invention relates to toys and game apparatuses and, more particularly, to toys and game apparatuses that a user may roll.

One of popular in-door activity games is bowling. In bowling, a user rolls a ball toward a number of pins, and the ball rolls a considerable distance along the bowling alley. Complicated and expensive equipment is required for a bowling game, as well as a specialized facility where users can play the game. Those factors prevent bowling from being played at home.

A variety of rolling toys for children are known. By way of example, U.S. Pat. No. 6,485,349 to Snyder and others discloses a rolling toy having a tubular assembly with a ball moving within a tubular assembly positioned inside the tubular assembly. When a user makes the toy rolling, audio and video signals are generated due to a motion sensor incorporated into body of the toy. U.S. Pat. No. 5,947,793 to Yamakawa provides a self-propelling rolling toy which is able to change the route of rolling movement if an obstacle is encountered by the toy. Both of the cited patents have a relatively complicated structure. Moreover, there is a need of rolling-type games, similar to bowling, that can be played at home.

SUMMARY OF THE INVENTION

The object of the present invention is to provide a new rolling toy which, when being thrown or rolled by a user, will roll on a horizontal support surface, for a certain distance and then stands up by itself. The rolling distance depends on a preliminarily adjustment to the rolling toy made by the user. The toy may be utilized for a completely new game.

One aspect of the invention provides a rolling toy having a primary roller and a secondary roller. The primary roller has a tubular-like member extending along a longitudinal axis thereof between left end and right end. The primary roller has at least one annular flange fixedly attached to the tubular-like member. The at least one annular flange is configured such that the primary roller is rollable on the at least one annular flange on a horizontal support surface. The tubular-like member has a substantially cylindrical interior surface. The secondary roller is sized to fit within the tubular-like member and is adapted for a rolling motion on the cylindrical interior surface when the longitudinal axis is orientated horizontally and the primary roller is in a rotational motion about the longitudinal axis.

As to another aspect of the invention, at least one of the following includes a helical guiding means: the tubular-like member and the secondary roller. The helical guiding means is/are configured for urging the secondary roller to move longitudinally toward the left end or the right end when the secondary roller is in the rolling motion on the substantially cylindrical interior surface of the tubular-like member.

As to a further aspect of the invention, configurations of the primary and secondary rollers and weights of the rollers are such that, as the primary roller is positioned having the longitudinal axis oriented horizontally, at least one of the following is satisfied: (a) a center of gravity of the rolling toy is located to the left of a leftmost annular flange of the at least one annular flange when the secondary roller is disposed on the substantially cylindrical interior surface in close proximity to the left end, (b) the center of gravity of the rolling toy is located to the right of a rightmost annular flange of the at least one annular flange when the secondary roller is disposed on the substantially cylindrical interior surface in close proximity to the right end, (c) a center of gravity of the primary roller is located to the left of a leftmost annular flange of the at least one annular flange, and (d) the center of gravity of the primary roller is located to the right of a rightmost annular flange of the at least one annular flange.

As to a further aspect of the invention, the tubular-like member includes a support area located on the leftmost or the rightmost portion thereof and configured such that the primary roller is positionable on the support area on the horizontal support surface, thereby, the tilting of the primary roller may result in the standing thereof on the horizontal support surface.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIGS. 4-A, 4-B, 4-C and 4-D are snapshots of the rolling toy rolling on the floor, view from the side;

FIGS. 11-A and 11-B are snapshots of the rolling toy rolling on the floor, where rotation is opposite to the one shown in FIG. 3;

FIG. 12 is a cross sectional view of a rolling toy illustrating the sixth embodiment ("single annular flange" schema);

FIGS. 13-A and 13-B are perspective views of a rolling toy illustrating the sixth embodiment, in the rolling and standing positions, correspondingly.

DETAILED DESCRIPTION OF THE PREFERRED EMBODIMENTS

Figure 1:
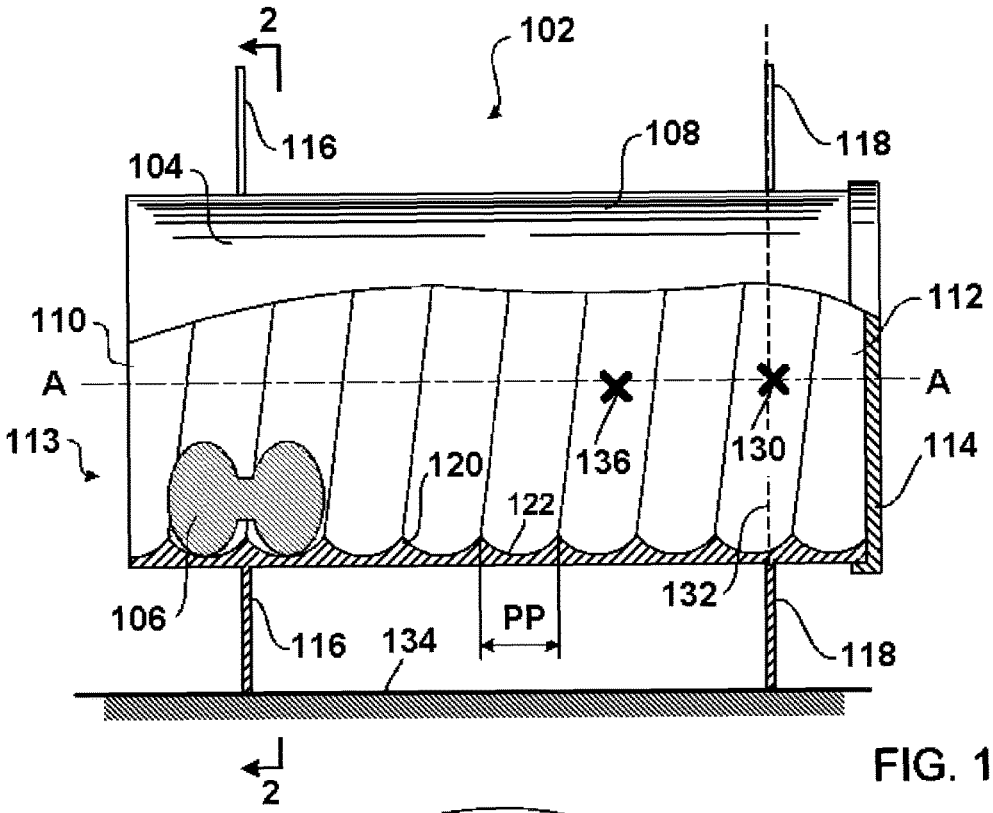
FIG. 1 is a partial cross sectional view of a rolling toy illustrating a first embodiment of the present invention.
Figure 2:
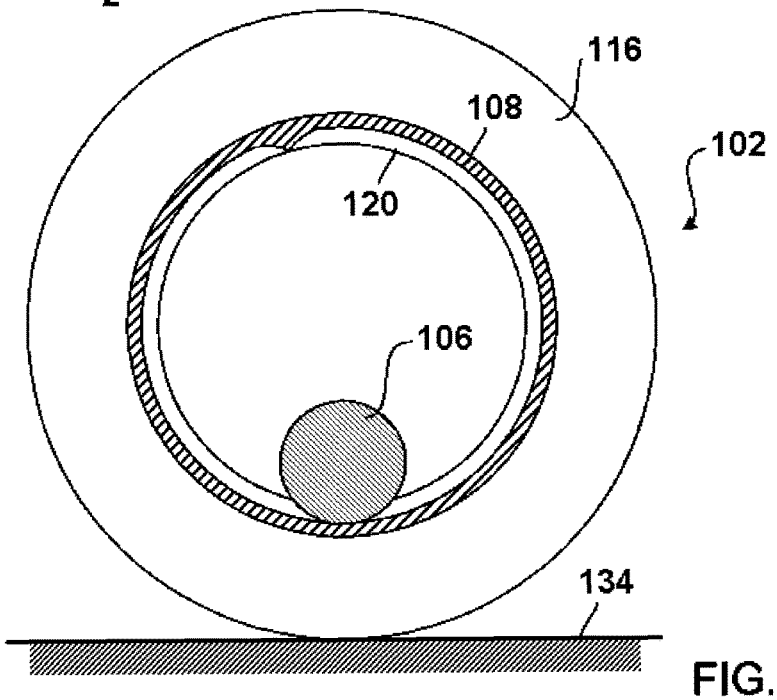
FIG. 2 is a cross sectional view of the rolling toy taken along the line 2-2 of FIG. 1.

Referring now to FIGS. 1 and 2, a rolling toy 102 according to a first embodiment of the present invention comprises a primary roller 104 and a secondary roller 106. The primary roller 104 comprises: a tubular-like member 108 made of a light-weight material and extending along a longitudinal axis A-A between left end 110 and a right end 112; a left annular flange 116 fixedly attached to the tubular-like member 108, extending radially outwardly thereof and positioned in the vicinity of the left end 110; a right annular flange 118 fixedly attached to the tubular-like member 108, extending radially outwardly thereof and positioned in the vicinity of the right end 112 and a counterweight which is implemented as a metal disk 114 fixedly attached to the tubular-like member 108 on the right end 112 thereof.

The tubular-like member 108 has an opening 113 in the left end 110. In FIG. 1 the left end 110 is on the left side and the right end 112 is on the right side; we will be using that convention throughout the present description. The left annular flange 116 and the right annular flange 118 have equal outer diameters and their axes coincide with the axis A-A. The primary roller 104 can roll on the annular flanges 116 and 118 upon a horizontal support surface 134, which can be, for instance, a floor.

The size, relative location and weight of the parts of the primary roller 104 are such that the center of gravity (COG) thereof is located in the position indicated by the cross 130: on the longitudinal axis A-A, close to an imaginary vertical plane 132 associated with the right annular flange 118. A light weight of the tubular-like member 108 and a heavy weight of the metal disk 114 define such location of the primary roller's COG.

A helical ridge 120 extends inwardly from a substantially cylindrical interior surface of the tubular-like member 108. The helical ridge 120 runs between the left end 110 and the right end 112. The helical ridge 120 forms a helical groove 122. As a way of example, the helical ridge 120 has a right hand helix; a pitch of the helix is marked in FIG. 1 as PP.

The secondary roller 106, preferably, has a shape of a dumbbell. A user initially holds the primary roller 104 so that axis A-A is oriented horizontally, then he/she places the secondary roller 106 inside the tubular-like member 108 through the opening 113 so that the secondary roller lays freely on the helical groove 122.

When the primary roller 104 is positioned on the horizontal support surface 134 and the secondary roller 106 lays on the helical groove 122 in the vicinity of the left end 110, COG of the rolling toy 102 (defined by a relative position, configuration and weights of the primary and secondary rollers) is located at the position indicated by the cross 136, between annular flanges 116 and 118. With that, projection of the rolling toy's COG on the support surface 134 lies between points of contact of the annular flanges with the support surface. Thereby, the rolling toy is in an equilibrium state. (When the secondary roller is positioned in the middle section of the tubular-like member, COG of the rolling toy is still located between the annular flanges). On the other hand, when secondary roller 106 lays on the helical groove 122 in the vicinity of right end 112, COG of the rolling toy lies to the right of the plane 132 which forces the rolling toy to tilt (this will be described in detail further). For simplicity, we'll be using the wording "the secondary roller inside the primary roller" instead of "the secondary roller inside the tubular-like member of the primary roller". It should be understood that shape of the secondary roller 106 can have a different than dumbbell; for instance, it can be shaped as a ball.

Figure 3:
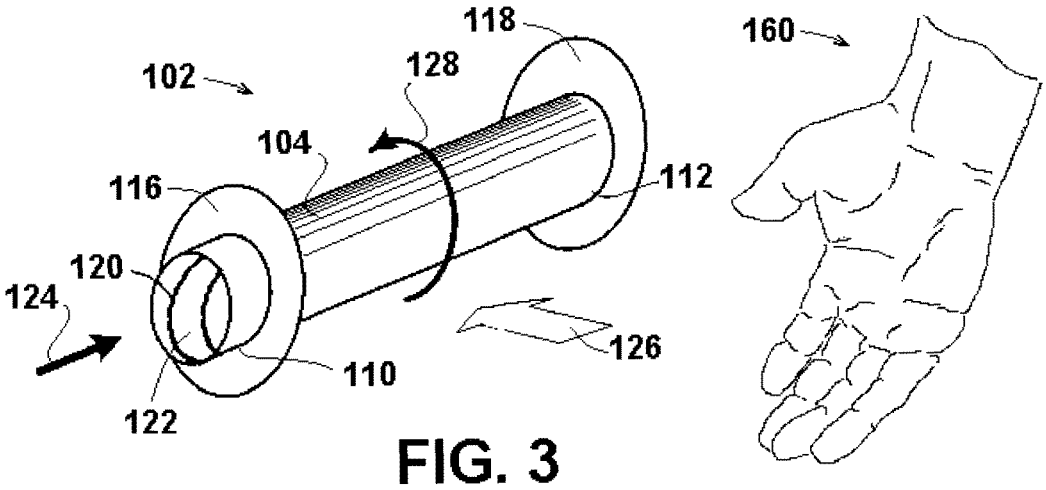
FIG. 3 is perspective view of the rolling toy which illustrates schematically directions of its rolling and rotation.

FIG. 3 illustrates how a user 160 plays with the rolling toy 102. Initially, while holding the rolling toy horizontally, he/she positions the secondary roller (not shown in FIG. 3) inside the primary roller 104 on the helical groove 122 near the left end 110. Then he/she rolls the rolling toy on the horizontal support surface. In the illustrated example, the left end 110 is on the left side relative to the user 160 and the primary roller 104 rolls in a direction indicated by arrow 126. Looking at the primary roller along its longitudinal axis from the left side, its rotation direction is counterclockwise as indicated by the curved arrow 128. When the primary roller is rolling, the secondary roller, which lies freely on the helical groove 122, remains in its lowest position (as illustrated in FIG. 1). Due to frictional engagement between their surfaces, the secondary roller is rolling upon the helical groove. As specified, the helical ridge 120 has a right hand helix, thereby, while the primary roller is rolling as illustrated in FIG. 3, the secondary roller moves longitudinally in the direction indicated by arrow 124, toward right end 112.

Four positions of the rolling toy 102 on the horizontal support surface are shown schematically in snapshots in FIGS. 4-A, 4-B, 4-C and 4-D. The notations used in these figures are the same as in FIG. 1. The snapshot FIG. 4-A illustrates a moment when the user initiates the primary roller's rolling. A location of the rolling toy's COG is indicated by the cross 136. With the primary roller rolling on the support surface and the secondary roller moving inside it in the rightward direction, COG of the rolling toy shifts rightward as well. Eventually, the COG reaches the location indicated by the cross 138, as illustrated in the snapshot FIG. 4-B. The location 138 of the COG lies to the right of the plane 132, which causes the rolling toy to lose its equilibrium state and to tilt in the direction indicated by the arrow 142.

Consequently, the rightmost circular edge of the metal disk 114 touches the horizontal support surface 134; the point of contact is marked as 144 in the snapshot FIG. 4-C. At this moment, the secondary roller is in the rightmost position inside the primary roller and COG of the rolling toy is located as indicated by the cross 140. Projection of the COG on the horizontal support surface lies to the right of the point of contact 144, so the rolling toy is still not in an equilibrium state and continues to tilt. That tilting ultimately cause the rolling toy to stand up vertically on the flat surface of the metal disk 114, as illustrated in the snapshot FIG. 4-D. The sadden termination of the rolling toy's rolling movement and changing of its orientation to vertical provides an amusement effect.

Figure 5:
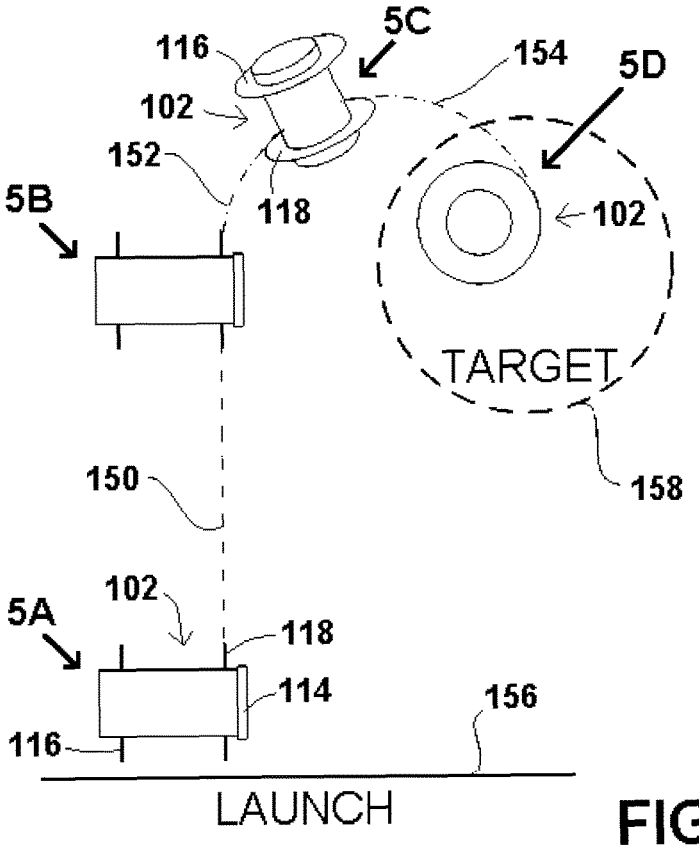
FIG. 5 shows snapshots of the rolling toy rolling on the floor, view from above.

Positions of the rolling toy 102, as they are seen from above, are illustrated in FIG. 5, where snapshots 5-A, 5-B, 5-C and 5-D correspond to the snapshots in FIGS. 4-A, 4-B, 4-C and 4-D, respectively. From the start of its rolling (snapshot 5-A), the rolling toy 102 rolls on two annular flanges along a straight line 150 until it starts tilting (snapshot 5-B). When the rolling toy starts tilting, the left annular flange 116 no longer touches the horizontal support surface. So the rolling toy rolls only on the right annular flange 118, along a curved line 152, until the rightmost circular edge of the metal disk 114 (see FIG. 4-C) touches the horizontal support surface as shown on the snapshot 5-C. Then the rolling toy rolls along the curved line 154 until it stands vertically, as illustrated in the snapshot 5-D.

A distance that the rolling toy rolls upon the support surface prior to standing up is, roughly:

$$\text{Dist_Roll}=3.14*\text{Diam_flange}*\text{Num_Rvl} \quad (1),$$

where Diam_flange is the outer diameter of the left and right annular flanges and Num_Rvl is the number of revolutions of the primary roller. In order to achieve the longest distance of the rolling toy rolling, the user initially disposes the secondary roller 106 inside the primary roller 104 in a position closest to left end 110 (see FIG. 1). Let us assume that the primary roller stops rolling when the secondary roller reaches the rightmost position on the helical groove 122. Correspondingly, a maximum number of the primary roller revolutions is approximately equal to number of coils of the helix, Num_Coils and the maximal distance which the rolling toy can rolls is:

$$Dist_Roll_Max=3.14*Diam_flange*Num_Coils \quad (2).$$

If the user places the secondary roller initially inside the primary roller 104 in a position closer to the right end, the distance of the rolling toy rolling is proportionally shorter than Dist_Roll_Max. For instance, if the initial position of the secondary roller is in the middle section of the primary roller then the rolling distance is twice shorter than Dist_Roll_Max.

Here is an example of the rolling toy design and dimensions. The helical ridge has ten coils. The pitch PP of the helix is 16 mm; a longitudinal length of the helix is 10*16 mm=160 mm. Outer diameter of the annular flanges is 130 mm. According to formula (2), distance Dist_Roll_Max is 4.1 m (about 13'). An inner diameter of the tubular-like member 108 is 50 mm. In general, according to our estimation, outer diameter of the annular flanges must be at least 25% larger than inner diameter of the tubular-like member.

Figure 6:
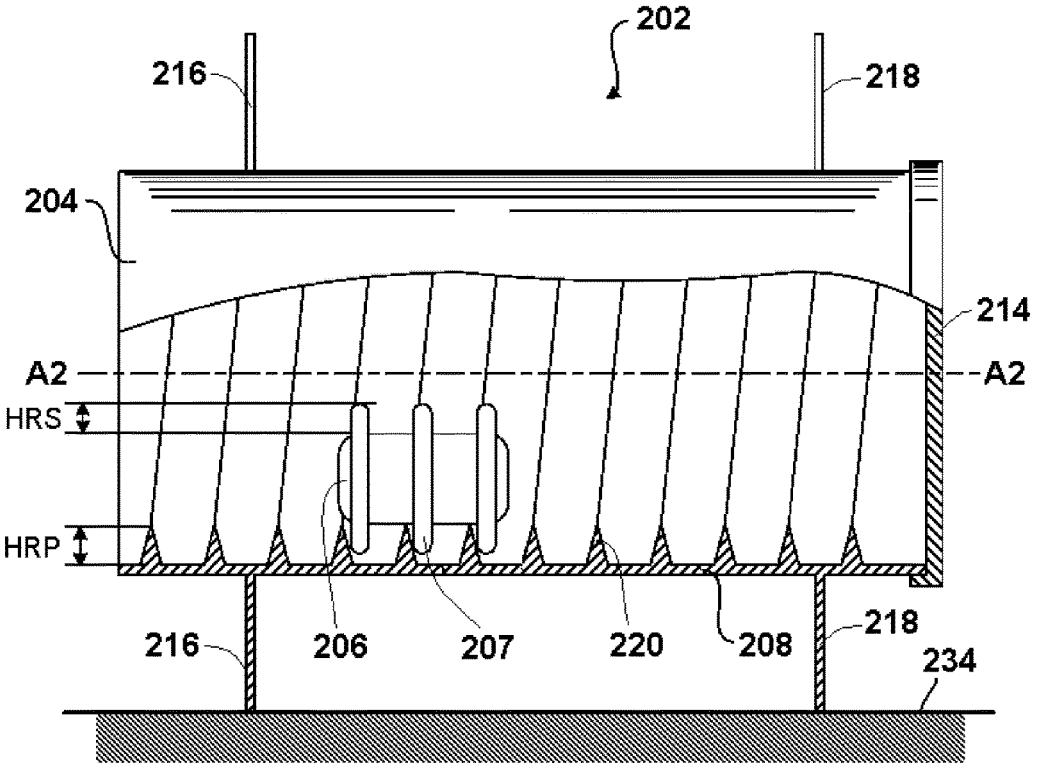
FIG. 6 is a partial cross sectional view of a rolling toy illustrating a second embodiment.

FIG. 6 illustrates a second embodiment of the rolling toy. Similar to the first embodiment, a rolling toy 202 comprises a primary roller 204 and a secondary roller 206. Primary roller 204 has a tubular-like member 208 extending along a longitudinal axis A2-A2, a left and a right annular flanges 216 and 218, correspondingly, and a counterweight which is implemented as a metal disk 214. A helical ridge 220 extends inwardly from the interior surface of the tubular-like member 208. The secondary roller 206 is formed as an elongated cylindrical roller with several circular ridges 207 extending outwardly. The secondary roller 206 is disposed inside the tubular-like member 208. Heights HRS of the circular ridges 207 are slightly smaller than heights HRP of the helical ridge 220 so the secondary roller lays on the helical ridge 220 when the primary roller 204 is oriented horizontally. Due to the frictional engagement between the exterior of the secondary roller 206 and the helical ridge 220, the secondary roller rolls upon the helical ridge when the primary roller rolls upon a support surface 234. It should be understood that configuration of secondary roller 206, primary roller 204 and its helical ridge 220 can be different from those shown in FIG. 6. For instance, the secondary roller may have only one circular ridge.

Figure 7:
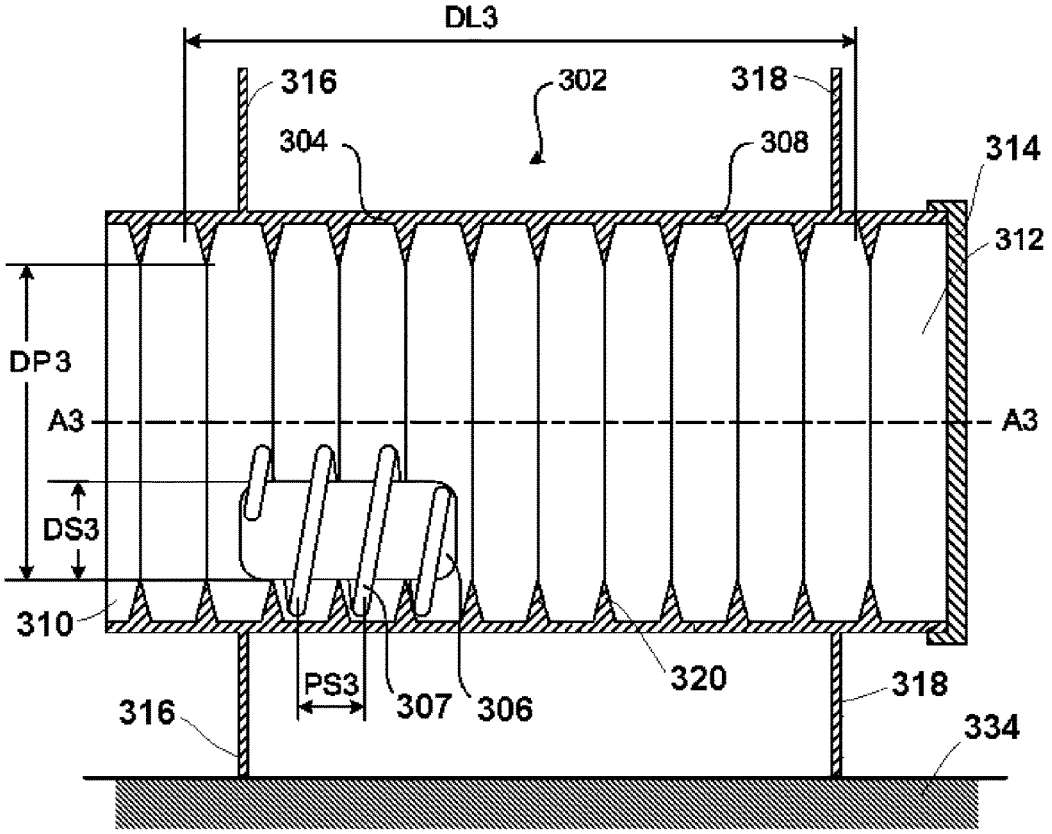
FIG. 7 is a partial cross sectional view of a rolling toy illustrating a third embodiment.

FIG. 7 illustrates a third embodiment of the rolling toy. Similar to the first embodiment, a rolling toy 302 comprises a primary roller 304 and a secondary roller 306. Primary roller 304 has a tubular-like member 308 extending along a longitudinal axis A3-A3 between a left end 310 and a right end 312. A plurality of equidistantly spaced apart circular interior ridges 320 are extending inwardly from the interior surface of the tubular-like member 308. The interior ridges 320 are coaxial with the axis A3-A3, their internal diameters are equal. The secondary roller 306 is formed as an elongated cylindrical roller with a helical ridge 307 extending outwardly from the cylindrical surface thereof. The helical ridge 307 has a left-hand helix. The pitch of the helix is marked in FIG. 7 as PS3. The distance between two adjacent interior ridges 320 is equal to the pitch of the helical ridge helix. The primary roller 304 has a left annular flange 316, a right annular flange 318 and a counterweight which is implemented as a metal disk 314.

When a user holds the primary roller 304 horizontally, he/she positions the secondary roller 306 on the interior ridges 320, close to the left end 310. When the primary roller rolls upon a support surface 334, the secondary roller 306 remains in the lowest position. Due to frictional engagement between the secondary roller and the interior ridges 320, the secondary roller rolls upon the interior ridges. Similar to the first embodiment, when the primary roller 304 rotates in the direction illustrated in FIG. 3 by arrow 128, the secondary roller 306 moves longitudinally in the direction indicated by arrow 124 because of engagement between helical ridge 307 and interior ridges 320. The longitudinal movement of the secondary roller 306 from left to right results in a shift of the rolling toy's COG and a corresponding tilt thereof when the secondary roller reaches the right end 312.

It should be understood that configuration of the primary and secondary rollers can be different than the configuration shown in FIG. 7. For instance, the distance between two adjacent interior ridges 320 can be twice longer than the pitch of the helical ridge helix. Also, the tubular-like member 308 can have multiple holes in its wall in order to make it lighter. The secondary roller can be formed as a helical spring.

Here is an assessment of the rolling toy's dimensions according to the third embodiment. A maximal distance DL3 of the longitudinal movement of the secondary roller 306 inside the primary roller 304 during the rolling toy's rolling is roughly:

$$DL3=NR3*PS3*DP3/DS3,$$

where NR3 is a maximal number of revolutions of the primary roller 304; DP3 is the inner diameter of interior ridges 320 and DS3 is a diameter of the secondary roller's 306 cylindrical body. As an example: NR3 is equal to ten; the pitch PS3 is 10 mm; diameter DP3 is 50 mm and diameter DS3 is 30 mm. With that, the distance DL3 is 167 mm. Correspondingly, a full length of the primary 304 roller along the axis A3-A3 is about 220 mm.

Figure 8:
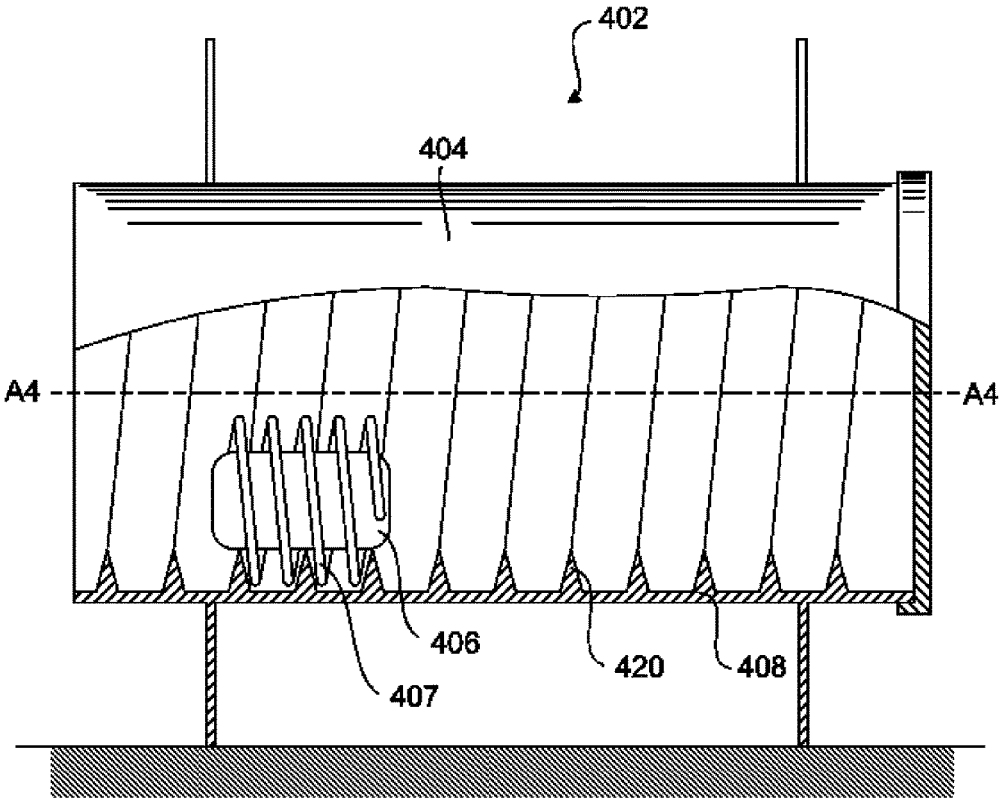
FIG. 8 is a partial cross sectional view of a rolling toy illustrating a fourth embodiment ("two helixes" schema)

FIG. 8 illustrates a fourth embodiment of the rolling toy. This is essentially a "two helixes" schema, a combination of the second and third embodiments. A rolling toy 402 comprises a primary roller 404 and a secondary roller 406. The primary roller 404 has a generally cylindrical tubular-like member 408 extending along a longitudinal axis A4-A4. A helical ridge 420 extends inwardly from an interior surface of the tubular-like member 408. The secondary roller 406 is formed as a cylindrical roller with a helical ridge 407 extending outwardly from the cylindrical surface therefrom. The helical ridge 420 and the helical ridge 407 both have right hand helixes.

When the primary roller 404 rotates in the direction illustrated in FIG. 3 by arrow 128, the secondary roller 406 moves longitudinally inside the primary roller in rightward direction a distance of DL4, which can be calculated roughly as:

$$DL4=NR4*(PP4-PS4*ID4/DS4),$$

here: NR4 is the number of revolutions of primary roller 404, PP4 is a pitch of the primary roller's helical ridge 420, PS4 is a pitch of the secondary roller's helical ridge 407, ID4 is an inner diameter of the primary roller's helical ridge 420, DS4 is a diameter of the secondary roller's cylindrical body.

With the specified configuration of the helixes and direction of the primary roller's rotation, the helical ridge 420 causes the longitudinal movement of the secondary roller 406 rightward, while the helical ridge 407 causes the longitudinal movement of the secondary roller 406 leftward. Thereby, a configuration of both rollers in which the "rightward-moving" component PP4 is slightly greater than the "leftward-moving" component PS4*ID4/DS4, provides a slow longitudinal movement of the secondary roller in the rightward direction. This provides for a longer distance of the rolling toy's rolling (more rotations) with a smaller number of coils of the helical ridge 420 and, correspondingly, smaller longitudinal size of the primary roller.

Figure 9:
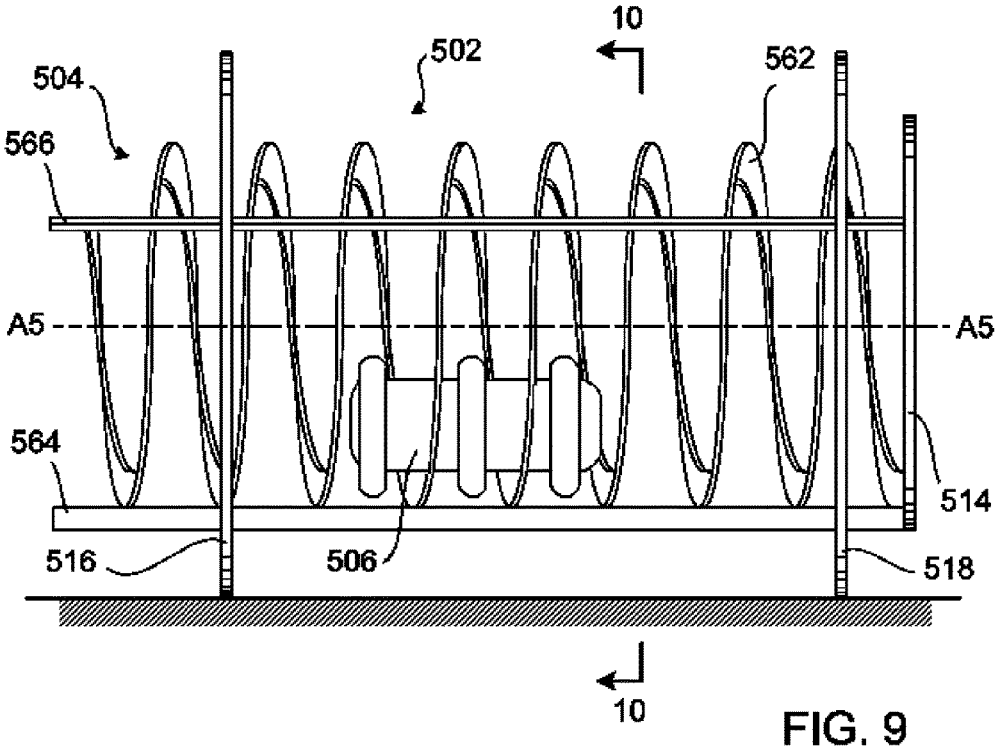
FIG. 9 is a side view of a rolling toy illustrating a fifth embodiment.
Figure 10:
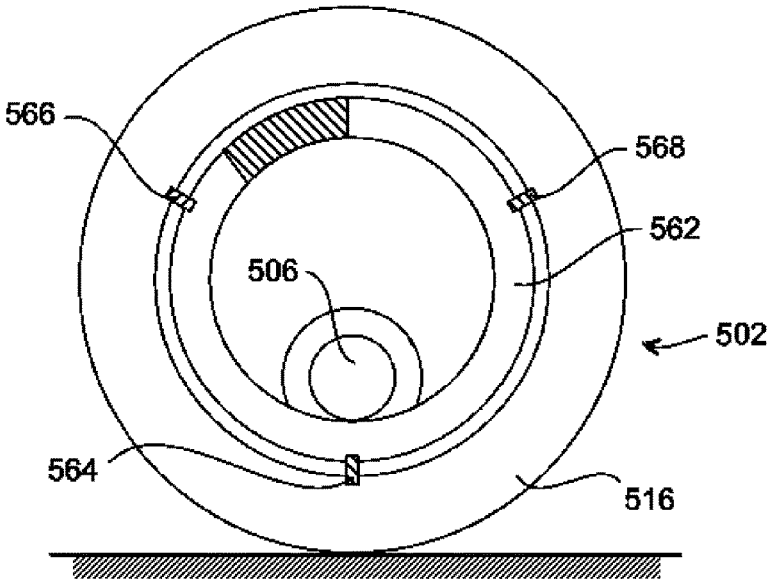
FIG. 10 is a cross sectional view of the rolling toy taken along the line 10-10 of FIG. 9.

Configuration of the primary roller of the rolling toy can be different from those described in the previous embodiments. For instance, FIGS. 9 and 10 illustrate a fifth embodiment, which is a variation of the second embodiment. Here, a rolling toy 502 comprises a primary roller 504 and a secondary roller 506. The primary roller 504 has a tubular-like member, which is implemented as a helical spring 562 extending along a longitudinal axis A5-A5. (The helical spring 562 has a configuration of a stretched Slinky toy). Three bars 564, 566 and 568 are attached to the exterior portions of the helical spring's coils. The bars are parallel to the longitudinal axis A5-A5. A left and a right washer-shaped flanges 516 and 518 are attached to the bars; the flanges 516 and 518 have equal outer diameters and their axes coincide with the axis A5-A5. A metal disc 514 is attached to the bars in their rightmost portions. The secondary roller 506 has a configuration similar the one of the secondary roller 206 (see FIG. 6). The secondary roller 506 is positioned in the interior of the helical spring 562 so that it lays freely on the coils thereof.

It is should be understood that the rolling toy can be used when the secondary roller moves longitudinally in the direction from right to left, which is opposite to the direction in the embodiments described hereinabove. Such a mode of operation is illustrated in FIGS. 11-A and 11-B. A rolling toy 1102, essentially identical to the one illustrated in FIGS. 1 and 2, comprises of a primary roller 1104 (having a tubular-like member 1108, a left annular flange 1116, a right annular flange 1118 and a counterweight which is implemented as a metal disk 1114), and a secondary roller 1106. An imaginary plane 1132 is associated with the right annular flange 1118. A helical ridge 1120 having a right hand helix extends inwardly from the interior surface of the tubular-like member 1108. In the primary roller's left end 1110 there is an opening 1113. As illustrated in FIG. 11-B, a primary roller's COG, marked as a cross 1138, is located slightly to the right of the plane 1132. Initially, a user places the secondary roller 1106 inside the tubular-like member 1108 in the middle portion thereof as shown in FIG. 11-A. With that, the rolling toy 1102 is in an equilibrium state when it stands on a support surface 1134. A COG of the rolling toy (as a combination of the primary and secondary rollers) is marked in FIG. 11-A as a cross 1136. The rolling toy's COG lies between the annular flanges 1116 and 1118; a projection of the COG on the support surface lies between the points of contact of the annular flanges with the support surface.

The user rolls the rolling toy on the support surface 1134 such that the primary roller 1104 rotates clockwise, looking at it along its longitudinal axis from the left side (the rotation is opposite from the one shown in FIG. 3 by the arrow 128). With that rotation, the secondary roller 1132 moves longitudinally in the leftward direction. Eventually, the secondary roller reaches the left end 1110 and falls on the support surface 1134 from the primary roller through the opening 1113. As the result, the primary roller loses its equilibrium state (due to location of its COG) and starts tilting as illustrated in FIG. 11-B. Then, in the same way as described hereinabove for the first embodiment, the primary roller stands up vertically on the flat surface of the metal disk 1114.

FIGS. 12, 13-A and 13-B illustrate a sixth embodiment of the rolling toy: a "single annular flange" schema. As illustrated in the cross sectional view FIG. 12, the rolling toy 602 comprises a primary roller 604 and a secondary roller 606. Primary roller 604 has a tubular-like member 608. A single annular flange 616 directly joints the tubular-like member 608 in the middle section thereof. The annular flange 616 has a rim 617. Similar to the third embodiment described hereinabove, a plurality of equidistantly spaced apart circular interior ridges 620 are extending inwardly from the interior surface of the tubular-like member 608. The secondary roller 606 is formed as a cylindrical roller with a helical ridge extending outwardly from the cylindrical surface thereof. The helical ridge has a left-hand helix.

When the primary roller 604 rolls upon a horizontal support surface as illustrated in the FIG. 13-A (direction of the primary roller rotation is marked by arrow 628), the secondary roller 606 moves in the rightward direction. When the rotation speed slows down and the secondary roller approaches the right end of the tubular-like member 608, the primary roller 604 tilts to the right and then falls on the support surface as it illustrated in the FIG. 13-B. A secondary roller with a right-hand helix can be utilized in this embodiment as well. With the right-hand helix, the secondary roller will move in the leftward direction when the primary roller rotates as illustrated in the FIG. 13-A and, correspondingly, the primary roller will tilt to the left when the secondary roller approaches the left end of the tubular-like member 608.

It should be understood that in the "single annular flange" schema, a different configuration of the tubular-like member and the secondary roller can be utilized Similar to the second embodiment, the interior surface of the tubular-like member may have a helical ridge (rather than the spaced apart circular interior ridges), and the secondary roller may have circular ridges extending outwardly its body. Another option might be the "two helixes" schema as in the fourth embodiment of the invention.

It should be understood also that directions of the helixes in the all of embodiments described hereinabove were selected by way of example. For instance, in the first embodiment, the helical ridge has a right hand helix. Therefore, under the conditions illustrated in FIG. 3, the secondary roller moves inside the primary roller longitudinally in the rightward direction. However, if the helical ridge of the primary roller had a left-hand helix, then the user would need to roll it in the opposite direction in order to make the secondary roller to move longitudinally in the rightward direction. Similarly, in the third embodiment the secondary roller can have a helical ridge with a right-hand helix; in the fourth embodiment ("two helixes" schema), both helixes can have the same (either both left or both right) or opposite directions. Also, multiple helixes can be utilized instead of a single helix in the primary rollers and/or in secondary rollers in the described embodiments.

It is also should be understood that shape, material and relative location of the parts of the rolling toy can be different from those described and illustrated hereinabove. For example, in the first embodiment, the secondary roller can have a spherical or semi-spherical shape. The tubular-like member can have, for instance, a shape of a barrel or slightly concave cylinder rather than a straight cylinder. Further, the annular flanges not necessarily have to be flat. For instance, instead of right annular flange described hereinabove, a rolling body of a semi-spherical shape, coaxial with the tubular-like member and fixedly attached thereto may be utilized. Further, the counterweight can be implemented, for instance, as a ring attached to outer surface of the right end section of the tubular-like member; the counterweight can be made of a non-metal material. The tubular-like member may have no openings on either of its ends so that the secondary roller could not be removed from the tubular-like member. Also, the primary roller in the embodiments described hereinabove can be implemented without the counterweight. In such implementation, the secondary roller must be heavy enough to cause the primary roller tilting to the left or to the right when the secondary roller is in the left end or in the right end of the primary roller, correspondingly.

A game that may be played on a substantially flat horizontal surface, for instance, on a floor, utilizing the rolling toy described hereinabove is contemplated. The game players, or one player, initially mark designated areas on the floor using a chalk or an adhesive tape: LAUNCH and TARGET, as shown in FIG. 5. By way of example: a line 156 defines the LAUNCH area and a circle 158 defines the TARGET area; the diameter of the TARGET area is 3 feet (0.9 m) and the distance between the LAUNCH and TARGET areas (between the line 156 and the circle 158) is 10 feet (3 m). The players are allowed to roll their rolling toys from the LAUNCH area. The goal of the game is to roll the rolling toy so that it ends up standing vertically inside the TARGET area. The challenge for the players in the game is to aim the rolling toy correctly and to choose a proper initial position of the secondary roller inside the primary roller (because the rolling toy's rolling distance depends on the initial position). Also, the players may have to consider previously launched rolling toys which may already occupy the TARGET area and those rolling toys which may stand between the LAUNCH and the TARGET areas. The players may be allowed to roll more than one rolling toy. It is to be understood that different rules of the game can be contemplated, for instance multiple LAUNCH and TARGET areas can be utilized.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A rolling toy comprising:

a primary roller and a secondary roller;

said primary roller has a tubular member extending along a longitudinal axis thereof between a left end and a right end;

said primary roller further has at least a left annular flange and a right annular flange which are fixedly attached to said tubular member;

said left annular flange and said right annular flange are configured such that said primary roller is rollable on the left annular flange and the right annular flange on a horizontal support surface;

said tubular member has a substantially cylindrical interior surface facing an interior of the tubular member;

wherein said left annular flange and said right annular flange are spaced apart along said longitudinal axis and have an equal outer diameter; configurations of said primary roller and said secondary roller and weights of the rollers are such that the center of gravity of said rolling toy is located between the left and right annular flanges when said primary roller is positioned having said longitudinal axis oriented horizontally and said secondary roller is disposed on said substantially cylindrical interior surface in a middle section of said tubular member;

said secondary roller is sized to fit within said tubular member and is adapted for a rolling motion on said substantially cylindrical interior surface;

wherein at least one of the following includes a helical guiding means: (i) said tubular member and (ii) said secondary roller;

said helical guiding means is/are configured for urging said secondary roller to move longitudinally toward said left end or said right end when said secondary roller is in the rolling motion on said substantially cylindrical interior surface;

configuration of the primary roller and weights of the primary and secondary rollers are such that, as the primary roller is positioned having said longitudinal axis oriented horizontally, at least one of the following is satisfied:

(a) a center of gravity of said primary roller is located approximately at a location of a vertical plane, substantially perpendicular to the longitudinal axis, and associated with the left annular flange or to the left of the left annular flange, and (b) the center of gravity of said primary roller is located approximately at a location of a vertical plane, substantially perpendicular to the longitudinal axis, and associated with the right annular flange or to the right of the right annular flange;

thereby, when said secondary roller is disposed on said substantially cylindrical interior surface in a predetermined location and said primary roller is set in a rolling motion on said horizontal support surface in a predetermined direction, the rolling motion of the primary roller results in a tilting thereof in respect to said horizontal support surface due to one of the following: (i) the longitudinal movement of said secondary roller toward said left end, (ii) the longitudinal movement of said secondary roller toward said right end, (iii) the longitudinal movement of said secondary roller toward said left end and subsequent detachment thereof from said tubular member, and (iv) the longitudinal movement of said secondary roller toward said right end and subsequent detachment thereof from said tubular member.

2. The rolling toy of claim 1, wherein said tubular member has a helical ridge extending inwardly from said substantially cylindrical interior surface or the tubular member is formed substantially as a helical spring; said secondary roller is configured for a rolling engagement with the helical ridge or the helical spring, thereby the helical ridge or the helical spring serve as said helical guiding means.

3. The rolling toy of claim 1, wherein said secondary roller is configured as an elongated body; the elongated body has a helical ridge extending outwardly from an exterior thereof or the elongated body is formed as a helical spring.

4. The rolling toy of claim 3, wherein a plurality of annular ridges spaced apart along said longitudinal axis is extending inwardly from said substantially cylindrical interior surface.

5. The rolling toy of claim 1, wherein said tubular member includes a support area located on the leftmost or the rightmost portion thereof and configured such that said primary roller is positionable on said support area on said horizontal support surface, thereby said tilting of the primary roller may result in a standing thereof on said horizontal support surface.

6. A rolling toy comprising:

a primary roller and a secondary roller;

said primary roller has a tubular member extending along a longitudinal axis thereof between left end and right end;

said primary roller further has a left rolling body and a right rolling body, which are spaced apart from each other along said longitudinal axis and fixedly attached to said tubular member;

said left rolling body and said right rolling body are configured such that said primary roller is rollable on said left rolling body and said right rolling body simultaneously on a horizontal support surface;

said tubular member has a substantially cylindrical interior surface facing an interior of the tubular member;

said secondary roller is sized to fit within said tubular member and is adapted for a rolling motion on said substantially cylindrical interior surface;

wherein said tubular member includes a helical guiding means;

said helical guiding means is configured for urging said secondary roller to move longitudinally toward said left end or said right end when said secondary roller is in the rolling motion on said substantially cylindrical interior surface;

configuration of the primary roller and weights of the primary and secondary rollers are such that, as the primary roller is positioned on said horizontal support surface, at least one of the following is satisfied:

(a) said primary roller is urged to tilt to the left when said secondary roller is positioned on said substantially cylindrical interior surface in close proximity to said left end; and (b) said primary roller is urged to tilt to the right when said secondary roller is positioned on said substantially cylindrical interior surface in close proximity to said right end;

thereby, when said secondary roller is disposed on said substantially cylindrical interior surface in a predetermined location and said primary roller is set in a rolling motion on the horizontal support surface in a predetermined direction, the rolling motion of the primary roller results in a tilting of the latter in respect to said horizontal support surface;

wherein the helical guiding means includes a plurality of revolutions; and wherein at least one complete revolution of the plurality of revolutions of the helical guiding means is approximately located at a vertical plane, substantially perpendicular to said longitudinal axis, and associated with at least one of the left rolling body, and the right rolling body.

7. The rolling toy of claim 6, wherein said tubular member has a helical ridge extending inwardly from said substantially cylindrical interior surface or the tubular member is formed substantially as a helical spring; said secondary roller is configured for a rolling engagement with the helical ridge or the helical spring, thereby the helical ridge or the helical spring serve as said helical guiding means.

8. The rolling toy of claim 6, wherein said secondary roller is configured as an elongated body; the elongated body has a helical ridge extending outwardly from an exterior thereof or the elongated body is formed as a helical spring.

9. The rolling toy of claim 6, wherein said tubular member includes a support area located on the leftmost or the rightmost portion thereof and configured such that said primary roller is positionable on said support area on said horizontal support surface, thereby said tilting of the primary roller may result in a standing thereof on said horizontal support surface.

10. A rolling toy comprising:

a primary roller and a secondary roller;

said primary roller has a tubular member extending along a longitudinal axis thereof between left end and right end;

said primary roller further has a left rolling body and a right rolling body, which are spaced apart from each other along said longitudinal axis and fixedly attached to said tubular member;

said left rolling body and said right rolling body are configured such that said primary roller is rollable on said left rolling body and said right rolling body simultaneously on a horizontal support surface;

said tubular member has a substantially cylindrical interior surface facing an interior of the tubular member;

said secondary roller is sized to fit within said tubular member and is adapted for a rolling motion on said substantially cylindrical interior surface;

wherein said secondary roller includes a helical guiding means on an exterior surface of the secondary roller;

said helical guiding means is configured for urging said secondary roller to move longitudinally toward said left end or said right end when said secondary roller is in the rolling motion on said substantially cylindrical interior surface;

configuration of the primary roller and weights of the primary and secondary rollers are such that, as the primary roller is positioned on said horizontal support surface, at least one of the following is satisfied:

(a) said primary roller is urged to tilt to the left when said secondary roller is positioned on said substantially cylindrical interior surface in close proximity to said left end; and (b) said primary roller is urged to tilt to the right when said secondary roller is positioned on said substantially cylindrical interior surface in close proximity to said right end;

thereby, when said secondary roller is disposed on said substantially cylindrical interior surface in a predetermined location and said primary roller is set in a rolling motion on the horizontal support surface in a predetermined direction, the rolling motion of the primary roller results in a tilting of the latter in respect to said horizontal support surface.

11. The rolling toy of claim 10, wherein said secondary roller is configured as an elongated body; the elongated body has a helical ridge extending outwardly from an exterior thereof or the elongated body is formed as a helical spring.

12. The rolling toy of claim 10, wherein said tubular member has a helical ridge extending inwardly from said substantially cylindrical interior surface, said secondary roller is configured for a rolling engagement with the helical ridge, thereby the latter serves as said helical guiding means.

13. The rolling toy of claim 10, wherein said tubular member has a helical ridge extending inwardly from said substantially cylindrical interior surface.

14. The rolling toy of claim 10, wherein a plurality of annular ridges spaced apart along said longitudinal axis extends inwardly from said substantially cylindrical interior surface; and said helical means of the secondary roller is configured to an engagement with the plurality of annular ridges when the secondary roller is in the rolling motion on said substantially cylindrical interior surface.

15. The rolling toy of claim 10, wherein said tubular member includes a support area located on the leftmost or the rightmost portion thereof and configured such that said primary roller is positionable on said support area on said horizontal support surface, thereby, said tilting of the primary roller may result in a standing thereof on said horizontal support surface.

* * * * *